United States Patent [19]

Yoshioka et al.

[11] 4,089,914

[45] May 16, 1978

[54] ACCELERATION DEVICE IN A CARBURETOR

[75] Inventors: Yuichi Yoshioka, Asaka; Yoshikatsu Nakano, Kawagoe, both of Japan

[73] Assignee: Honda Giken Kogyo Kabushiki Kaisha, Tokyo, Japan

[21] Appl. No.: 713,970

[22] Filed: Aug. 12, 1976

[30] Foreign Application Priority Data

Aug. 18, 1975 Japan ..... 50-113022[U]

[51] Int. Cl.[2] ..... F02M 7/08

[52] U.S. Cl. ..... 261/34 A; 261/DIG. 39

[58] Field of Search ..... 261/34 A, 78 R, DIG. 39, 261/64 R

[56] References Cited

U.S. PATENT DOCUMENTS

| | | | |
|---|---|---|---|
| 1,763,361 | 6/1930 | Kirby | 261/34 A |
| 1,923,429 | 8/1933 | Ericson | 261/34 A |
| 2,744,736 | 5/1956 | Evinrude | 261/72 R |
| 2,967,697 | 1/1961 | Sellers | 261/51 |
| 3,017,167 | 1/1962 | Griffen | 261/34 A |
| 3,100,236 | 8/1963 | Ott et al. | 261/34 A |
| 3,290,023 | 12/1966 | Sarto | 261/34 A |
| 3,957,929 | 5/1976 | Gural et al. | 261/34 A |

FOREIGN PATENT DOCUMENTS

| | | | |
|---|---|---|---|
| 1,153,209 | 8/1963 | Germany | 261/34 A |
| 301,222 | 9/1932 | Italy | 261/34 A |

*Primary Examiner*—Tim R. Miles

*Attorney, Agent, or Firm*—Haseltine, Lake & Waters

[57] ABSTRACT

An acceleration device including an acceleration fuel spray nozzle arranged on the upstream side of the choke valve and a through aperture formed in the latter to allow the fuel spray from the nozzle to freely proceed to the engine even when the choke valve is closed. There is no unwanted squirt of fuel during engine starting or high speed operation and formation of any overrich fuel-air mixture or depletion of the fuel passage extending to the nozzle is effectively prevented.

2 Claims, 1 Drawing Figure

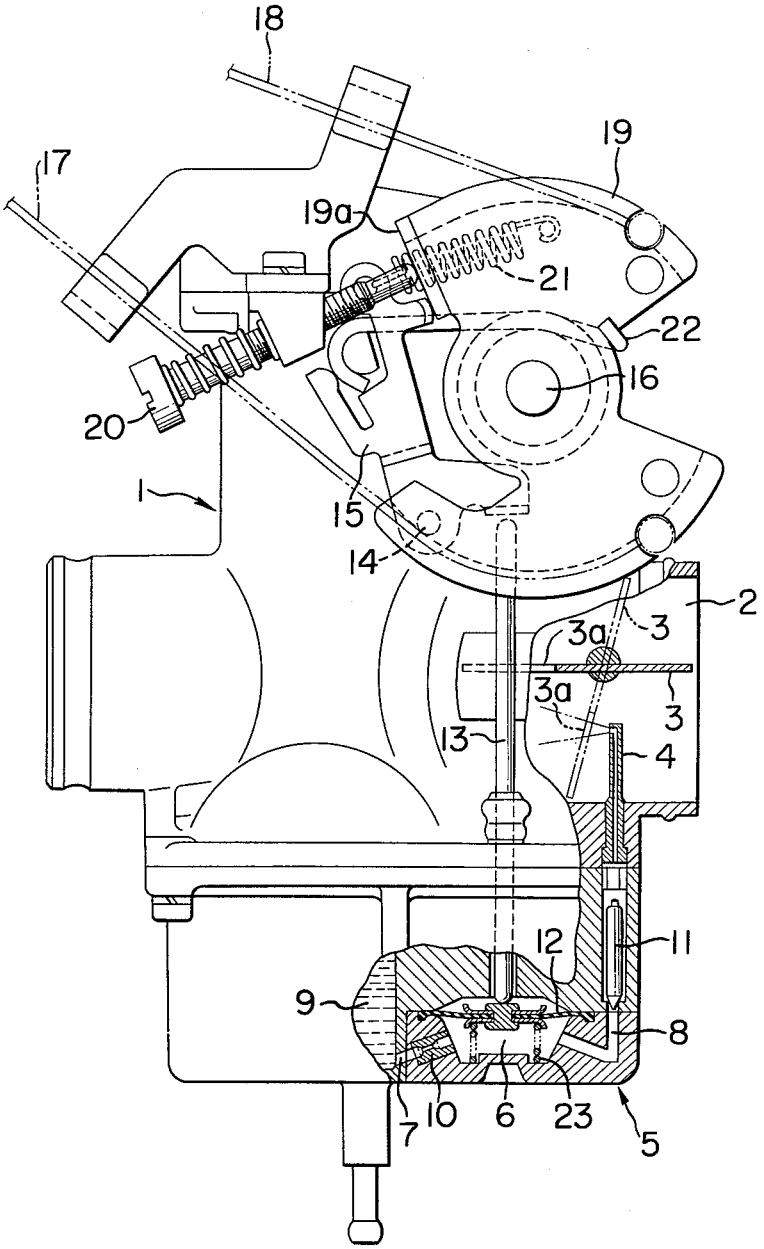
18
17
19
19a
21
22
16
20
1
15
14
2
3a
3
3a
3
13
4
12
11
9
8
10
6
23
7
5

ACCELERATION DEVICE IN A CARBURETOR

FIELD OF THE INVENTION

This invention relates generally to carburetors and more particularly to acceleration devices usable thereon and including an accelerating pump operable in response to the engine acceleration operation and an acceleration fuel spray nozzle connected with the delivery side of the accelerating pump to spray fuel into the air intake duct for expediting engine acceleration.

Prior Art

With such devices, the acceleration fuel spray nozzle has conventionally been arranged with its spray orifice opening to the air intake duct on the downstream side of the choke valve. This nozzle arrangement is advantageous in that it makes it possible to feed the engine with acceleration fuel even when the choke valve is in its closed position during the engine warm-up period. With the conventional arrangement, however, particularly when the engine is started or run at high speed with the choke valve fully closed or slightly opened, the higher engine suction, acting on the acceleration fuel spray nozzle, often produces an unwanted squirt of fuel and hence the formation of an overrich fuel-air mixture which results in misfiring and unstable engine operation. Such unwanted fuel squirt has also involved the danger that the fuel passage between the accelerating pump and the acceleration fuel spray nozzle become depleted, rendering the device unable to supply any predetermined amount of acceleration fuel to the engine upon subsequent engine acceleration operation, and the acceleration characteristic of the engine is materially impaired.

SUMMARY OF THE INVENTION

The present invention has for its object the provision of an acceleration device of the above kind which is free from any of the difficulties previously encountered as described above.

To attain this object, the present invention proposes to arrange the acceleration fuel spray nozzle in the intake duct on the upstream side of the choke valve and to form a through aperture in the choke valve in a position to face the nozzle orifice or outlet opening of the acceleration fuel spray nozzle when the choke valve is closed thereby to allow the fuel spray leaving the nozzle orifice to proceed freely through the aperture to the downstream side of the choke valve.

The above and other objects, features and advantages of the present invention will become apparent from the following description when taken in conjunction with the accompanying drawing.

BRIEF DESCRIPTION OF THE DRAWING

The drawing includes a single figure which represents a side elevational view, partly in vertical cross section, of a preferred embodiment of the invention.

DESCRIPTION OF THE PREFERRED EMBODIMENT

In the drawing, reference numeral 1 generally indicates a carburetor on which is provided an acceleration device embodying the present invention and, as shown, the carburetor 1 has an intake duct 2 in which choke valve 3 is pivotally arranged in the upstream or atmospheric side portion of the duct. Though not shown in the drawing, a throttle valve is pivotally arranged in the intake duct 2 in the downstream or engine side portion thereof. According to the present invention, an acceleration fuel spray nozzle 4 is arranged to extend vertically into the intake duct 2 on the upstream side of the choke valve 3. According further to the present invention, the choke valve 3 is apertured, as indicated at 3a, in a position to face the outlet opening of the acceleration fuel spray nozzle 4 when the choke valve 3 is closed, as shown.

Reference numeral 5 generally indicates an accelerating pump provided on the carburetor 1; and 6 indicates a working chamber defined in the pump 5. A delivery passage 8 extends generally upwardly from the pump chamber 6 and is connected at the top with the acceleration fuel spray nozzle 4. Reference numeral 7 indicates a suction or inlet passage to the pump chamber 6 and which passage is held in fluid communication with a float chamber 9 at a level below the surface of the liquid fuel held therein. As shown, the float chamber 6 is arranged under the intake duct 2 closely thereto. A constriction or orifice element 10 is inserted in the inlet passage 7 while a vertical check valve 11 is arranged in the delivery passage 8 to allow fuel flow therethrough only in an upward direction. The pump chamber 6 has a movable top wall in the form of a diaphragm 12 which is operatively connected at the center with the end of one arm of a bell crank lever 15 through the medium of a vertically extending push rod 13. The bell crank lever 15 is pivoted to the carburetor casing on the outside thereof.

Also, supported on the carburetor 1 is a throttleoperating shaft 16 which is operatively connected with the throttle valve (not shown). A pulley 19 is fixedly mounted on one end portion of the throttle-operating shaft 16 and is rotatable under the pull of throttle wires 17 and 18 provided respectively for opening and closing the throttle valve. The pulley 19 is formed on one side thereof with an abutment surface **19*a* which is engageable with the tip end of an idling stop screw 20 adjustably mounted on the outside of the carburetor 1. The abutment surface 19*a* is normally held in abutting engagement with the other arm of bell crank lever 15 under the bias of a coiled tension spring 21 which is arranged between the pulley 19 and bell crank lever 15. Reference numeral 22 indicates a restoring spring connected with the pulley 19 to aid the throttle closing operation and 23 indicates a restoring spring arranged in the pump chamber 6 to normally bias the diaphragm 12** upward.

Description will next be made of the operation of the embodiment described.

First, when the engine is started or operated at high speed with the choke valve 3 fully closed or slightly opened, any high suction or intake vacuum occurring in the duct 2 on the downstream side of the choke valve 3 exerts no influence on the acceleration fuel spray nozzle 4, located on the upstream side of the choke valve 3, and hence there is no unwanted squirt of fuel liquid from the nozzle 4.

Next, when the throttle-opening wire 17 is drawn for engine acceleration, the pulley 19 and throttle-operating shaft 16 are rotated in a clockwise direction, as viewed in the drawing, to quickly open the throttle valve (not shown). Simultaneously with this, the bell crank lever 15 is turned in the same direction following the rotation of the pulley 19 as the lever is connected therewith by the coil spring 21. As the result, the push rod 13 is driven vertically downward by the associated arm of the bell crank lever 15 to push down the diaphragm 12 in the action of accelerating pump 5 against the restoring spring 23 and the pump chamber 6 is thus quickly reduced in volume. Accordingly, the fuel in the pump chamber is pressurized and forced into the delivery passage 8 by the aid of the constriction 10 in the inlet passage 7 and, flowing through the discharge or check valve 11 into the acceleration fuel spray nozzle 4, is sprayed into the intake duct 2, as indicated by the chain-dotted lines. In this connection, it is to be clearly recognized that, even where the choke valve 3 is held closed, as shown, the fuel spray can freely proceed to the downstream side of the choke valve 3 through the aperture 3*a* formed therein and now directly facing the outlet opening of the fuel spray nozzle 4. In this manner, the fuel sprayed into the intake duct 2 can be fed freely to the engine together with the intake air to expedite the engine acceleration despite the choke valve 3 being held closed.

In this connection, it is to be noted that, even after the diaphragm 12 in the accelerating pump 5 has been driven to its lower limit, the pulley 19 can further be rotated clockwise to increase the throttle opening as the coil spring 21, arranged between the pulley 19 and bell crank lever 15, is extensible to allow the pulley 19 to rotate separately from the bell crank lever 15. That is to say, the pulley 19 can rotate clockwise to any desired extent to increase the throttle opening without any hindrance of the accelerating pump 5.

Subsequently, when the throttle-closing wire 18 is drawn to rotate the pulley 19 and the throttle-operating shaft 16 in a counter-clockwise direction for engine deceleration, the bell crank lever 15 turning in the same direction allows the push rod 13 associated therewith to rise so that the diaphragm 12 in the pump chamber 6 assumes its normal, upper position under the bias of restoring spring 23 and fuel liquid is drawn from the float chamber 9 into the pump chamber 6 through the inlet passage 7 for the next engine acceleration as the pressure in the chamber 6 is reduced.

To summarize, there is provided, according to the present invention, a novel and improved acceleration device usable on a carburetor and including, an acceleration fuel spray nozzle 4 arranged on the upstream side of the choke valve 3 and a through aperture 3*a* formed in the choke valve to allow the fuel spray from the nozzle 4 to proceed freely into the engine even when the choke valve is in its closed position. With use of such device, it will be readily appreciated that, even when the choke valve is held closed, there is no impairment of the engine acceleration characteristic and that any unwanted squirt of fuel liquid under engine suction is effectively prevented and any trouble as previously met in cold starting and warm-up operation of the engine is avoided.

Though one preferred embodiment of the invention has been shown and described, it will be readily understood that many changes and modifications may be made therein without departing from the spirit of the invention or the scope of the appended claims.

What is claimed is:

1. An acceleration device in a carburetor having an intake duct with an upstream side and a downstream side, said acceleration device comprising an acceleration pump operable in response to an engine acceleration operation, said acceleration pump having an inlet side and a delivery side, a choke valve disposed in the upstream side of the intake duct, and an acceleration fuel spray nozzle connected to the delivery side of said acceleration pump and projecting laterally into said intake duct on the upstream side of said choke valve, said nozzle comprising a tube having an axial bore, an outlet opening extending laterally into said bore and facing downstream in said duct, and being closed to flow proceeding downstream in said duct, said choke valve having an aperture therein in immediate proximity to the outlet opening of said acceleration fuel spray nozzle when said choke valve is closed whereby said nozzle discharges a spray of fuel through said aperture, said choke valve being pivotable about a central portion and including upper and lower portions, said lower portion being provided with the aperture, said outlet opening facing said aperture in said lower portion when the choke valve is closed.

2. An acceleration device as claimed in claim 1 wherein said acceleration pump comprises a pump chamber having a flexible wall, the carburetor having a fuel chamber, a connection being provided between said fuel chamber and pump chamber including an orifice element, and a delivery passage connecting said pump chamber to said nozzle and including a check valve.

* * * * *